US007152672B1

(12) United States Patent
Gipson

(10) Patent No.: US 7,152,672 B1
(45) Date of Patent: Dec. 26, 2006

(54) COMBINATION WORKOVER AND DRILLING RIG

(76) Inventor: Tommie C. Gipson, 19668 County Rd., Eaton, CO (US) 80615

( * ) Notice: Subject to any disclaimer, the term of this patent is extended or adjusted under 35 U.S.C. 154(b) by 0 days.

(21) Appl. No.: 11/338,573

(22) Filed: Jan. 24, 2006

Related U.S. Application Data

(60) Provisional application No. 60/730,740, filed on Oct. 27, 2005.

(51) Int. Cl.
*E21B 19/22* (2006.01)
*E21B 19/00* (2006.01)

(52) U.S. Cl. ..... 166/77.2; 175/162; 280/656; 242/397.2; 242/403

(58) Field of Classification Search ..... 166/77.2; 175/162; 242/397.2, 403; 280/656
See application file for complete search history.

(56) References Cited

U.S. PATENT DOCUMENTS 4,673,035 A * 6/1987 Gipson ..... 166/77.1
5,842,530 A * 12/1998 Smith et al. ..... 175/162
6,092,756 A * 7/2000 Sola ..... 242/399.2
6,502,641 B1 * 1/2003 Carriere et al. ..... 166/384
6,530,432 B1 * 3/2003 Gipson ..... 166/384
6,973,979 B1 * 12/2005 Carriere et al. ..... 175/203
2006/0000619 A1 * 1/2006 Borst et al. ..... 166/384

* cited by examiner

*Primary Examiner*—Jennifer H. Gay
*Assistant Examiner*—Shane Bomar
(74) *Attorney, Agent, or Firm*—Elizabeth R. Hall

(57) ABSTRACT

The combination workover and drilling rig of the present invention combines a capability to drill a well, as well as perform well maintenance and service, using either or both tubing with threaded tubular connections or coiled tubing. A mast and a coiled tubing injector are independently mounted to a support platform and can be operated independently of each other. The coiled tubing injector is selectably elevatable into a stowed position, a ready position, or an operating position.

24 Claims, 6 Drawing Sheets

COMBINATION WORKOVER AND DRILLING RIG

CROSS-REFERENCE TO RELATED APPLICATION

The present application, pursuant to 35 U.S.C. 111(b), claims the benefit of the earlier filing date of provisional application Ser. No. 60/730,740 filed Oct. 27, 2005, and entitled "Combination Workover and Drilling Rig."

BACKGROUND OF THE INVENTION

1. Field of the Invention

The present invention relates to a workover and drilling rig for use in servicing and stimulating existing wells and drilling new wells for the production of fluids from subterranean formations. The present invention is particularly suited for use in oil and gas production.

2. Description of the Related Art

Truck or trailer-mounted conventional drilling and workover rigs are typically of either of two basic types. The first type, which is used for conventionally threaded tubulars, consists of the combination of a mobile supporting platform (e.g., a trailer or a truck bed) and an elevatable rig mast. The second type, which is used for coiled tubing, consists of a mobile supporting platform, a coiled tubing reel, a levelwind mechanism, and a conventional opposed track tubing injector. In both cases, pumps and other peripheral equipment are often included. The advantages and disadvantages of these types of workover rigs are well known. While these conventional rigs are readily transportable, easy to rig up and down, and economical, they are limited to use with either one or the other type of tubular.

A mobile combination coiled tubing and threaded tubing rig has been developed by Coiled Tubing Solutions, of Eastland, Tex. 76448. This combination rig uses a wheel type injector mounted in the mast with its axis of rotation above midheight of the mast. Additionally, a coiled tubing reel with an independent levelwind mechanism is mounted on the mobile supporting platform of the rig. This combination rig is very top heavy and wind sensitive. Furthermore, when the mast is stowed, the weight distribution of the rig is overly concentrated on the forward end of the truck or trailer on which the rig is mounted. Additionally, this type unit is limited in coiled tubing size because of highway vehicle height limits and their attendant limitations on reel and injector wheel size. This limitation arises because of the projection of the injector wheel above the bed of the trailer or truck used for the mobile platform. In addition, the coiled tubing must be inserted into the wheel injector after the mast is elevated and removed before the mast is lowered.

A need exists for an improved combination workover and drilling rig that can raise and lower the coiled tubing injector independently from the raising and lowering of the conventional rig mast.

Furthermore, there is a need for a combination workover and drilling rig that permits the coiled tubing to be engaged by the tubing injector at all times.

SUMMARY OF THE INVENTION

The invention contemplates an improved workover and drilling rig for solving the problems and disadvantages of the prior approaches discussed above. The present invention provides a combination workover and drilling rig that performs well maintenance and service, as well as drilling new wells, using tubing with threaded tubular connections and/or coiled tubing. A mast and a coiled tubing injector are independently mounted to a support platform and can be operated independently of each other.

One aspect of the present invention is a workover and drilling rig comprising: a support platform; an elevatable mast mounted on the support platform, wherein the mast has an attached lifting mechanism; a selectably rotatable coiled tubing storage reel; and an elevatable coiled tubing injector assembly mounted on the support platform proximal to the mast.

Another aspect of the present invention is a workover and drilling rig comprising: a support platform; an elevatable mast mounted on the support platform, wherein the mast has an attached lifting mechanism; a selectably rotatable coiled tubing storage reel; and an elevatable coiled tubing injector assembly mounted on the support platform, wherein the injector assembly includes a drive wheel, a rotatable drive wheel frame having a guide roller track and a plurality of holddown rollers attached to the drive wheel frame, and a hinged support arm attached at one end to the support platform and at a second end to the drive wheel frame.

Yet another aspect of the present invention is a mobile workover and drilling rig comprising: a mobile support platform; a mast mounted on the support platform in a storage position that is substantially horizontal over the support platform; a coiled tubing storage reel; a coiled tubing injector assembly mounted on the support platform in a storage position, wherein a portion of a drive wheel of the injector assembly is positioned within an opening in the mast and a rotatable drive wheel frame having a guide roller track and a plurality of holddown rollers attached to the drive wheel frame is positioned such that the guide roller track and the holddown rollers are proximal to the support platform.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The combination drilling and workover rig of the present invention combines a capability to drill wells, as well as perform well maintenance and service, using either or both tubing with threaded tubular connections or coiled tubing. Some of the components used in this improved combination rig are well known in the oilfield. However, several of the components have been modified and the arrangement and operation of the components of the rig are unique and confer several advantages over rigs of conventional construction. A preferred embodiment of the combination drilling and workover rig is mobile being mounted on a truck or trailer bed.

Figure 1:
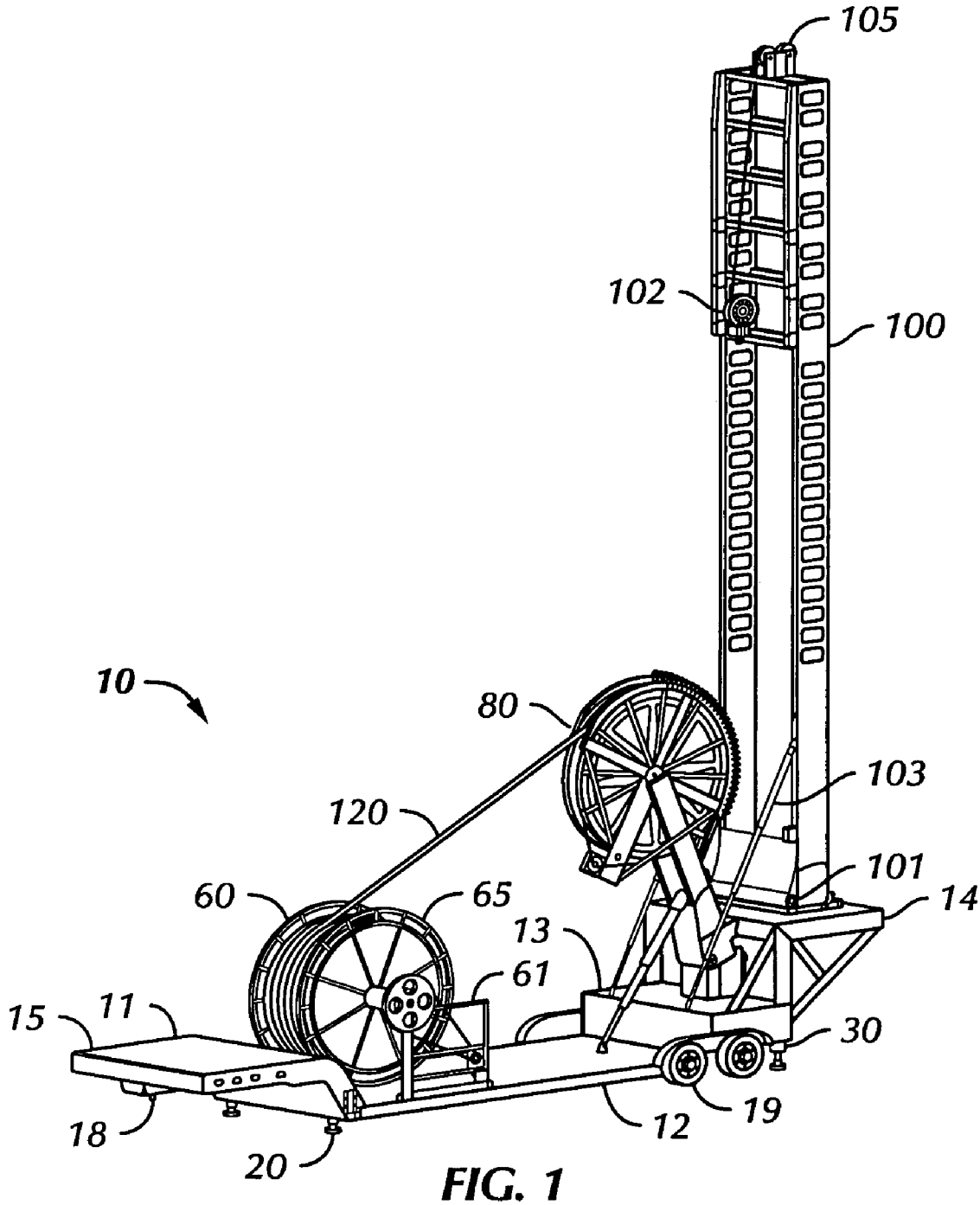
FIG. 1 is an oblique view of the combination workover and drilling rig of the present invention.
Figure 2:
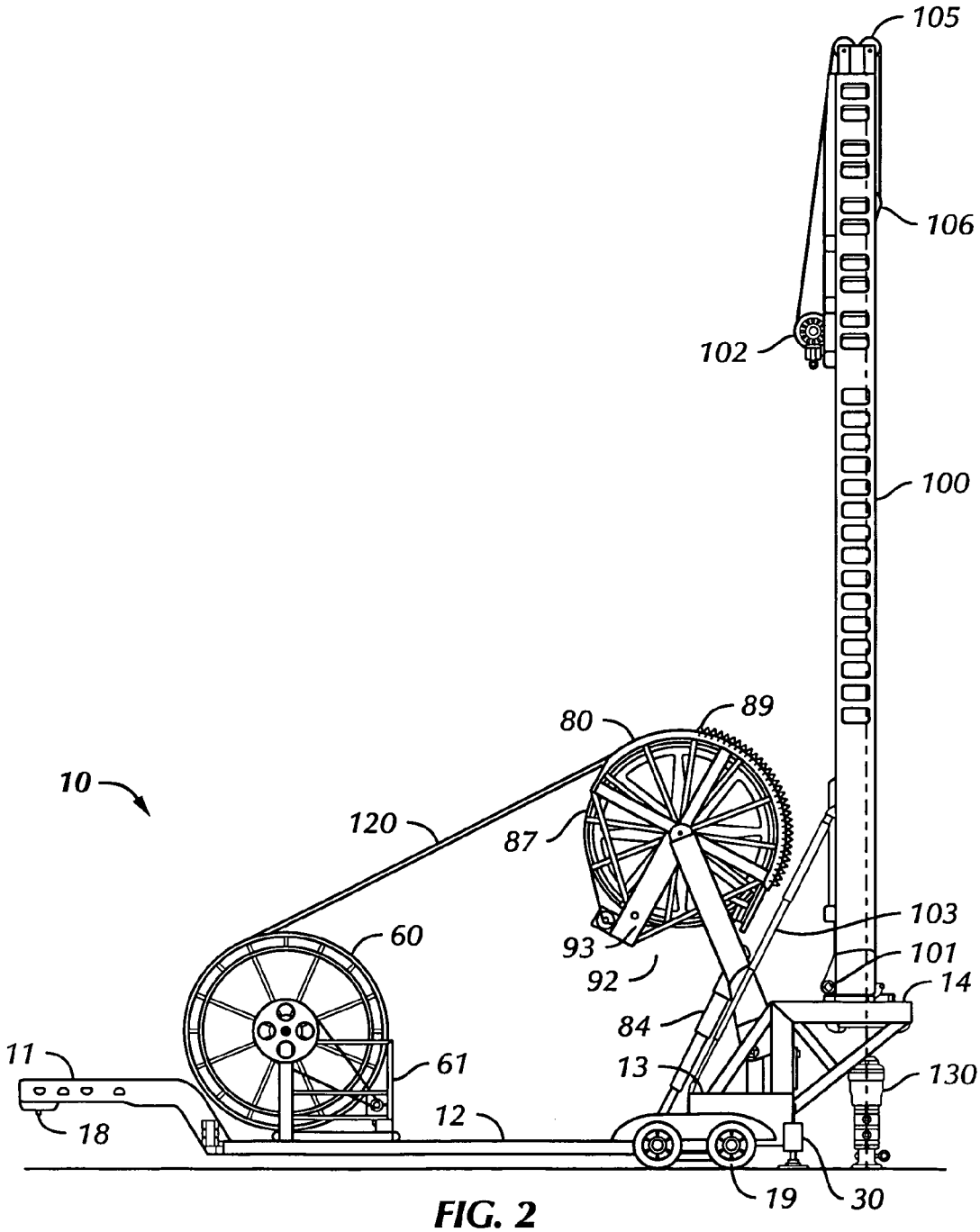
FIG. 2 is a side profile view of the rig of FIG. 1, where the rig is arranged to perform downhole work using the rig mast and rotary table with the coiled tubing injector retracted.
Figure 3:
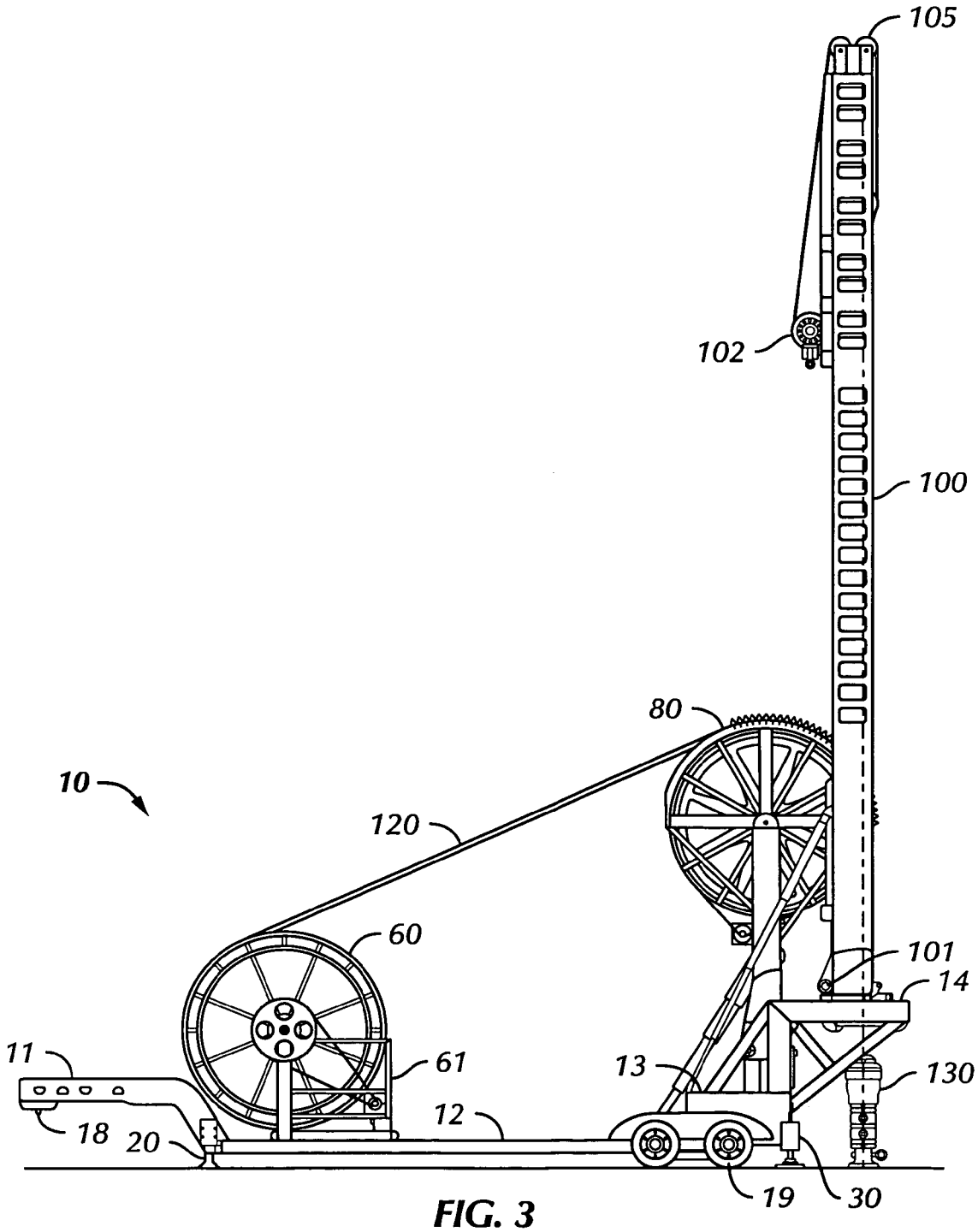
FIG. 3 is a side profile view of the rig of FIG. 1, wherein the coiled tubing injector is extended over the wellhead.
Figure 4:
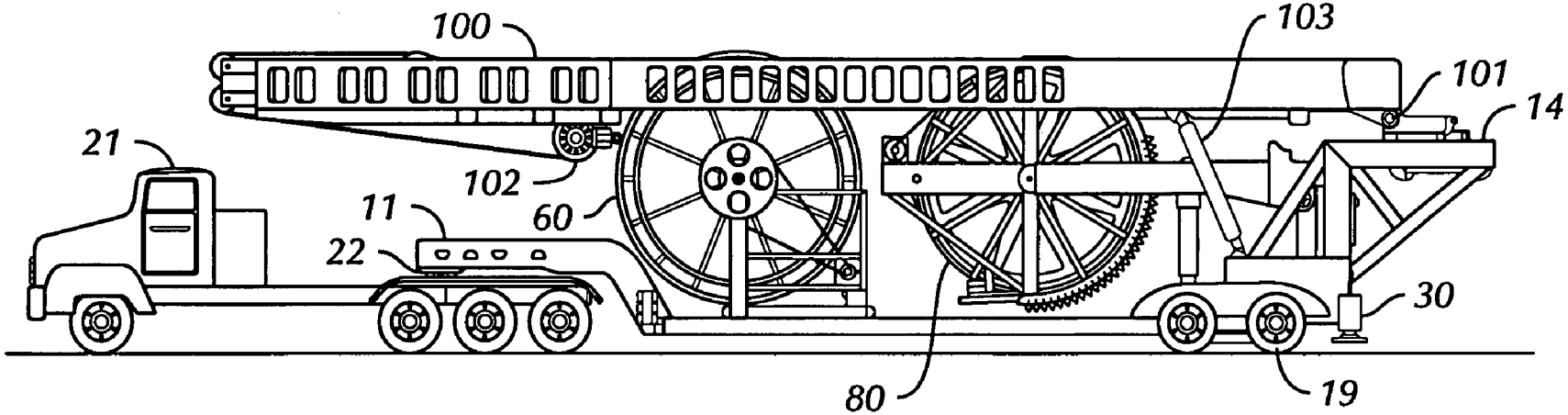
FIG. 4 is a side profile view of the rig showing the mast and coiled tubing injector lowered to their traveling position and the rig trailer attached to a truck for towing.

Referring to FIG. 1 particularly, but also to FIGS. 2, 3, and 4, the improved mobile combination rig 10 is seen in two different operational positions and, in FIG. 4, its traveling configuration. As shown herein, the rig 10 is mounted on a modified conventional low-boy trailer 11 which has a dropped center section 12 and an elevated rear section 13. The elevated rear section 13 supports a rearwardly projecting horizontal rig floor structure 14 that is elevated above the elevated rear section. The supports for the rig floor structure 14 are two mirror image trusses in the vertical plane, wherein each truss has a vertical post and an inclined knee supporting the forward edge of the rig floor and a second inclined knee supporting the rear edge of the rig floor.

The forward section 15 of the trailer 11 is elevated above the center section 12 and is cantilevered forward with a vertically downwardly projecting king pin 18 centrally located on the lower side of the forward section. The king pin 18 is used to engage the fifth wheel 22 of a tractor rig 21 so that the rig 10 can be towed. Two or more transverse axles mounted beneath the rear section 13 of the trailer 11 support wheels with tires 19 so that the trailer can be rolled.

One or more vertically extendable forward support jacks 20 and rear support jacks 30 have support plates at their lower ends. The forward support jacks 20 are symmetrically positioned on both sides at the forward end of the center section 12 of the trailer 11. Normally these jacks 20 are retracted for travel, but whenever the trailer 11 is positioned for either parking or being set up at a well location, the jacks are extended downwardly to support the forward end of the trailer on the ground.

One or more rear support jacks 30 are located on the rear end of the elevated rear section 13 of the trailer 11. The rear support jacks 30 have hydraulically extensible and retractable cylinders so that they are able to provide vertical support for the rear of the trailer 11 in the manner of the forward trailer support jacks 20, as shown in particular in FIG. 2.

As seen in FIGS. 1 through 4 and 8, the coiled tubing storage reel assembly 60 is mounted at the forward end of the dropped center section 12 of the trailer 11 on the trailer longitudinal centerline. The storage reel assembly 60 is constructed to avoid the need for a separate levelwind mechanism by allowing the reel 65 to pan laterally in order to urge the coiled tubing 120 to properly spool onto the reel 65. The coiled tubing storage reel assembly 60 has a frame 61 directly mounted to the trailer 11 and supporting a transversely reciprocable, selectably controllable, hydraulically positioned subframe.

The reel 65 is chain driven by a selectably controllable hydraulic motor which can run in either direction. Because the coiled tubing 120 must undergo reverse bending every time it is reeled off and back on the reel, the diameter of the reel 65 is selected to be the minimum which will give a desired fatigue life for a given tubing size.

Figure 5:
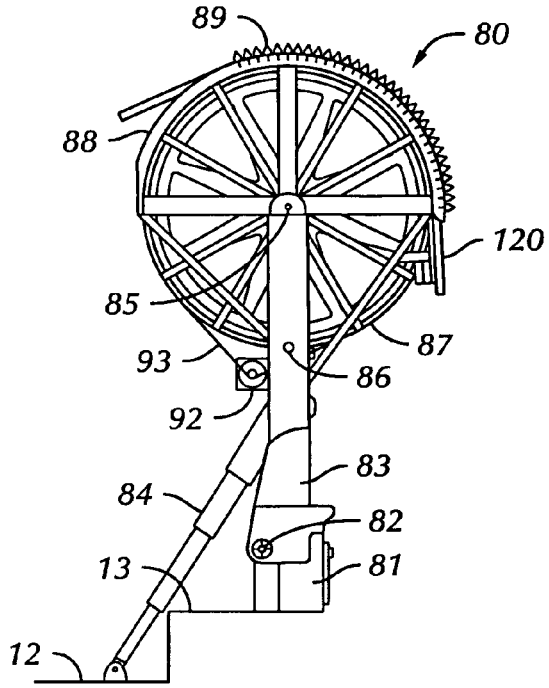
FIG. 5 shows the coiled tubing injector in its erect, working position, which corresponds to the position shown in FIG. 3.
Figure 6:
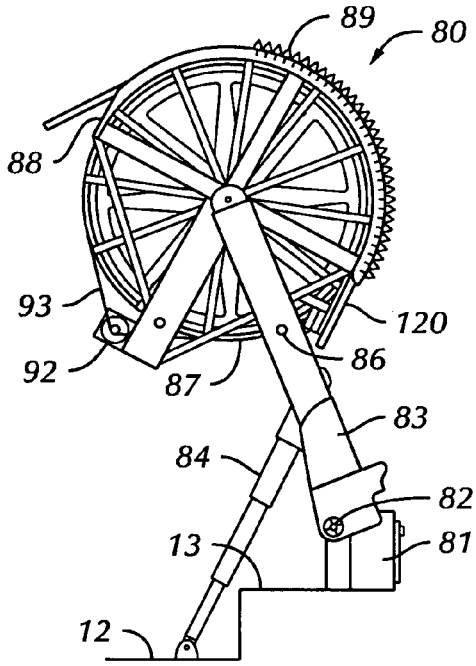
FIG. 6 shows the coiled tubing injector in its retracted ready position where it is withdrawn to permit use of the rig mast which corresponds to the position shown in FIG. 2.
Figure 7:
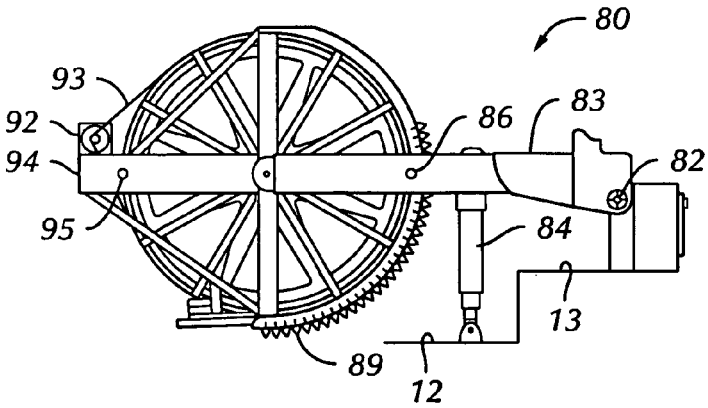
FIG. 7 shows the coiled tubing injector in its stowed position which corresponds to the position shown in FIG. 4.

The coiled tubing injector assembly 80, shown in detail in FIGS. 5, 6, and 7, consists of a hinged arm supporting substructure which mounts a conventional wheel type coiled tubing injector wheel in a novel manner. Rectangular prismatic pedestal 81 is mounted on the centerline of the trailer 11 on elevated rear section 13. Pedestal 81 at its forward upper edge supports a transverse axis right circular cylindrical hinge pin 82.

Support arm 83 consists of two spaced-apart parallel mirror-image rectangular cross-section tubes cojoined by a central tubular crossbar. At their first ends, the parallel tubes of support arm 83 have coaxial transverse pin holes which are engaged by the hinge pin 82. Attached to the middle of the tubular crossbar of support arm 83 is a clevis to which one end of clevis-mounted telescoping hydraulic elevator cylinder 84 is mounted. The other end of telescoping cylinder 84 is clevis mounted near the rear of dropped center section 12 of the trailer 11. At their second ends, the parallel tubes have coaxial through holes that mount right circular cylindrical axle 85. Colinear transverse through holes perpendicular to the vertical midplane of trailer 11 extend through the parallel tubes of support arm 83 between the tubular crossbar and the second end of the parallel tubes. An inwardly extending axially reciprocable right circular cylindrical keeper pin 86 is engaged in the transverse holes in each of the parallel tubes.

The drive wheel 87 has a central right circular cylindrical tubular housing which serves as a hub for the wheel and which journals the axle 85 of the support arm 83, thereby permitting the drive wheel to rotate freely about the axle. Radial spokes extend outwardly from the central tubular housing and connect to a constant radius circular tire at the outer periphery of the drive wheel 87. The outer tire has a central external annular groove configured to provide close-fitting transverse support to the coiled tubing 120 over a substantial portion of the tubing circumference. The drive wheel 87 has a chain sprocket attached integrally with the tire on each side of the drive wheel.

Drive wheel frame 94 is symmetrical about the vertical longitudinal plane of the trailer 11 and the support arm 83. Drive wheel frame 94 consists of a pair of spaced apart parallel rectangular tubular beams which support an arcuate guide roller track 88 at their first ends and a crossbeam at their second ends. The guide roller track 88 has a constant radius with an arc length of approximately 180° and mounts multiple transverse axis holddown rollers 89 which extend from one side of the guide roller track to the other. These holddown rollers bear on the coiled tubing 120, thereby firmly urging the coiled tubing against the groove of the tire of the drive wheel 87 so that substantial circumferential frictional forces can be developed between the drive wheel 87 and the coiled tubing 120. Both the arcuate guide roller track 88 and the crossbeam interconnect the parallel beams of drive wheel frame 94. A parallel beam of drive frame 94 is located on each outer side of the drive wheel 87. In the central portion of the parallel beams on the first end side of the midpoint are located coaxial through transverse holes which journal the axle 85 of the support arm 83. These transverse holes are perpendicular to the vertical midplane of the drive wheel 87 and provide a pivot axis for the drive wheel frame 94.

Located near the second end of each of the parallel beams of the drive wheel frame 94 is a transverse keeper pin hole 95 which is selectably engagable by the keeper pin 86 on its side of the support arm. These two transverse holes for the keeper pins 86 are coaxial. Symmetric radial beams extend outwardly in the plane of the parallel beams from the pivot axis of the drive wheel frame 94 and provide radial support to the guide roller track 88. A selectably controlled hydraulic drive motor 92 is mounted on the crossbeam at the second end of drive wheel frame 94 with its double-ended drive shaft horizontal and parallel to the axis of drive wheel 87. The drive motor 92 is provided with a chain sprocket on each end of its drive shaft so that the sprockets can be used to drive the integral sprockets of the drive wheel 87 through the dual drive chains 93.

The mast 100 of rig 10, shown in particular in FIG. 1, is of conventional construction and is symmetric about the vertical midplane of the trailer 11. Herein, mast 100 is shown as interconnected parallel beams with lightening holes, but a trussed construction could equally well be utilized. At its lower end and at the forward side of the mast 100 when it is erected, each of the parallel beams of the mast has a transverse hole engaged by elongate right circular cylindrical pin, which serves as a mast hinge 101. The mast hinge 101 is mounted transversely near the forward side of the rig floor structure 14. The crossbeams between the parallel beams of the mast 100 are confined to the upper end of the erected mast except for one large dross-beam at the lower end of the mast.

Mounted on a crossbeam near the upper end of the mast 100 is a hydraulic winch 102, which has a cable that extends over the twin sheaves of the crown block assembly 105 and to the dependent traveling block assembly 106. The crown block assembly 105 and the traveling block assembly 106 are of the typical construction used on rigs. The crown block assembly 105 is located at the upper end of the erected mast 100. A telescopic hydraulic erection cylinder 103 is attached at its first end to the forward side of each of the parallel beams of the erected mast 100 at a distance from the hinge 101. The erection cylinders are mounted at their second ends to the elevated rear platform 13.

OPERATION OF THE INVENTION

The operation of the improved combination rig is such that it can operate at the same well with either or both tubing having conventional threaded tubular connections or coiled tubing. This flexibility is achieved not only as a consequence of the physical arrangement of the components on the trailer of the rig, but also by the mounting and structure of the coiled tubing injector.

The rig is brought to a well location for the performance of workover operations by the tractor 21 pulling its attached trailer 11. For traveling, the forward support jacks 20 and the rear support jacks 30 are retracted. To begin rig operations the trailer 11 is backed up to its desired working position, such as where the rig floor structure 14 of the trailer is centered over the wellhead 130. Once the rig is in place the trailer is generally uncoupled from the tractor 21 by disconnecting the kingpin 18 of the trailer from the fifth wheel 22 of the tractor.

The front end of the trailer 11 is then leveled by means of the forward trailer support jacks 20. Following this, the rear end of the trailer is leveled by selectably vertically extending the cylinder rods of the rear support jacks 30. Typically, the wheels with tires 19 of the trailer 11 are lifted partially from the ground so that they no longer fully support the rear of the trailer.

In order to initiate workover operations using the mast 100, the mast is elevated to its vertical position shown in FIG. 3 from its traveling stored position shown in FIG. 4 by means of the erection cylinders 103 pivoting the mast about the hinge 101. In this vertical position, the hydraulic winch 102 can be used to operate the traveling block 106 to perform any lifting and lowering operations required for the rig, including running and pulling threaded connections. Normally, lifting and lowering operations are required, even if the well is to be drilled or worked over using coiled tubing. For this reason, the mast is normally placed in its vertical operating condition shown in FIG. 2. If the coiled tubing 120 is not to be used for the workover, then the coiled tubing injector 80 is left in its stored position.

If the coiled tubing 120 is to be used to drill or workover the well, then the support arm 83 of the coiled tubing injector 80 is elevated by using the cylinders 84 to pivot the support arm about its hinge pin 82 to the intermediate or ready position shown in FIGS. 1 and 2. In this position, the injector 80 is set back from the mast 100 so that conventional operations can be conducted using the lifting capabilities of the mast.

Figure 8:
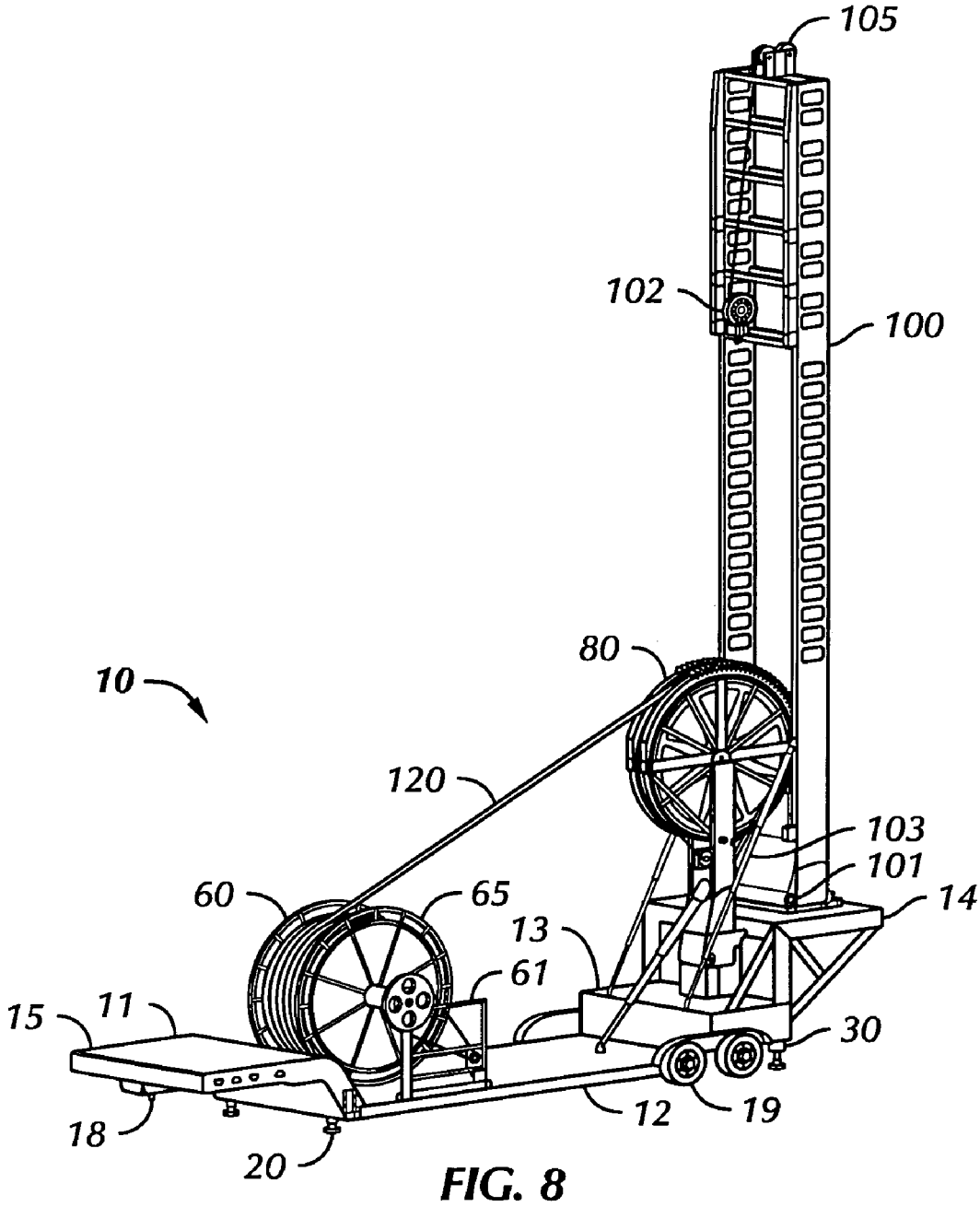
FIG. 8 is an oblique view corresponding to FIG. 3 showing the coiled tubing injector in position for operation.

When coiled tubing operations are to be initiated, the support arm 83 is moved to the vertical position shown in FIGS. 3 and 8 by using the elevator cylinders 84. At least a portion of the injector drive wheel 87 is located between the vertical beams of the mast 100 when in the vertical position, and the departure axis of the tubing 120 from the injector is vertical. At that point, the drive motor 92 can be selectably operated to manipulate the coiled tubing into or out of the well. The storage reel 60 for the coiled tubing 120 is simultaneously selectably operated to pay tubing out or to retrieve and levelwind it.

Referring to FIGS. 5, 6, and 7, it can be seen that the orientation of the drive wheel frame 94 relative to the support arm 83 for the coiled tubing injector is changed from its traveling or stored position shown in FIG. 7 to the ready and operating positions shown in, respectively, FIGS. 6 and 5. These drive wheel frame 94 positions are different so that it is possible to lower the overall height of the rig 10 when it is in its traveling position shown in FIG. 4. For the traveling position shown in FIG. 7, the drive wheel frame is rotated relative to the support arm 83 so that the guide roller track 88 with its holddown rollers 89 is not on the upper side of the injector. At this time, the keeper pin 86 is not engaged in the keeper pin hole 95, so that the drive wheel frame 94 is rotationally free to move relative to the support arm 83.

In order to move the drive wheel frame 94 to its operational position, the drive motor 92 is not permitted to rotate as the support arm 83 is lifted. At the same time, the storage reel 60 is locked against rotation so that the drive wheel frame is rotated counterclockwise from its position shown as the support arm is raised. This rotation is due to the fact that the distance between the points of tangency of the coiled tubing between the storage reel 60 and the injector drive wheel 87 is fixed due to the locking of those two rotary members. Accordingly, when the support arm 83 moves upwardly, the drive wheel frame 94 is dragged counterclockwise relative to the support arm. The frame 94 is pinned to the support arm 83 by engaging the keeper pins 86 in the keeper pin holes 95 when the two items are aligned. With the pinning of pins 86 into holes 95, the frame 94 cannot rotate relative to the arm 83. This permits a reaction force between the frame 94 and the arm 83 so that torque can be applied to the drive wheel 87 by the drive motor 92 and hence tension applied to the coiled tubing 120.

When the coiled tubing injector is to be lowered to its storage or traveling position of FIG. 7 from the positions shown in either FIG. 5 or 6, the keeper pins 86 are disengaged from the keeper pin holes 95 and the drive motor 92 is slowly rotated as the arm 83 is lowered by the cylinders 84. The operator carefully controls this operation so that the tubing 120 is neither buckled between the reel and the injector nor caused to partially unwind from the reel 60. At all times the coiled tubing 120 is engaged with the coiled tubing injector 80.

ADVANTAGES OF THE INVENTION

The combination rig 10 of the present invention offers several advantages over commercially available rigs, both conventional rigs and combination rigs. Because the injector mechanism is located lower, the center of gravity and wind stability of the erected rig are considerably improved. Additionally, the lowering of the operational position of the injector improves accessibility and makes personnel operations much safer than for other rigs. Raising the injector separately from the rig mast also makes it easier to retract the injector to improve access for conventional lifting operations using the mast.

The use of a lowboy trailer along with the ability to rotate the drive wheel frame so that the holddown rollers and guide roller track are not projecting upwardly when the rig is traveling. The rotation of the drive wheel frame such that the guide roller track and the holddown rollers are rotated towards the truck or trailer bed in its storage position reduces the traveling height of the rig. This relative lowering of the rig further improves rig stability when traveling and allows an operator to use a larger diameter injector wheel without being over permitted heights for highway driving. Since the coiled tubing must undergo reverse bending every time it is reeled off and back on the reel, the larger the diameter of the reel the less fatigue of the coiled tubing occurs and the life of the coiled tubing is extended.

The ability of the coiled tubing system to maintain the tubing fully engaged by the injector at all times, rather than having to disengage and reengage it as with existing combination rigs, results in considerable time savings to the rig operators.

Having described an embodiment of the combination rig of the present invention, it is believed that modifications, variations, and changes will be suggested to those skilled in the art in view of the description set forth above. It is therefore to be understood that all such variations, modifications, and changes are believed to fall within the scope of the invention as defined in the appended claims.

What is claimed is:

1. A combination rig comprising:

a support platform;

an elevatable mast mounted on the support platform, wherein the mast has an attached lifting mechanism;

a selectably rotatable coiled tubing storage reel mounted on the support platform; and an elevatable coiled tubing injector assembly mounted on the support platform between the mast and the coiled tubing storage reel;

whereby the mast and the coiled tubing injector are independently operable.

2. The combination rig of claim 1, wherein the support platform has wheels.

3. The combination rig of claim 1, wherein the support platform is a trailer or a truck bed with a dropped center section.

4. The combination rig of claim 3, wherein the coiled tubing storage reel is mounted on the dropped center section.

5. The combination rig of claim 1, wherein the coiled tubing storage reel is transversely reciprocable to provide levelwinding of coiled tubing on the storage reel.

6. The combination rig of claim 1, wherein the coiled tubing injector assembly includes a coiled tubing drive wheel attached to a first end of a support arm having a second end pivotably mounted to the support platform.

7. The combination rig of claim 6, wherein the support arm is attached to an elevator cylinder that reciprocably pivots the support arm moving the coiled tubing drive wheel into an operating position.

8. The combination rig of claim 6, wherein the support arm is attached to an elevator cylinder that reciprocably pivots the support arm moving the coiled tubing drive wheel into a stowed position, a ready position or an operating position.

9. The combination rig of claim 8, wherein the mast operation is unimpeded by the coiled tubing injector whenever the coiled tubing injector is displaced from its normal operating position.

10. The combination rig of claim 1, wherein the mast does not impede the use of the coiled tubing injector.

11. The combination rig of claim 1, wherein the coiled tubing injector assembly includes a drive wheel, a rotatable drive wheel frame having a guide roller track and a plurality of holddown rollers attached to the drive wheel frame, and a pivotable support arm attached at one end to the support platform and at a second end to the drive wheel frame.

12. The combination rig of claim 11, wherein the pivotable support arm is attached to an elevator cylinder that reciprocably pivots the support arm thereby moving the coiled tubing drive wheel and the drive wheel frame into a stowed position, a ready position or an operating position.

13. The combination rig of claim 12, wherein the drive wheel frame rotates as the support arm pivots and moves the drive wheel and the drive wheel frame.

14. A combination rig comprising:

a support platform;

an elevatable derrick mast mounted on the support platform, wherein the mast has an attached lifting mechanism;

a selectably rotatable coiled tubing storage reel; and an elevatable coiled tubing injector assembly mounted on the support platform, wherein the injector assembly includes a drive wheel, a rotatable drive wheel frame having a guide roller track and a plurality of holddown rollers attached to the drive wheel frame, and a hinged support arm attached at one end to the support platform and at a second end to the drive wheel frame.

15. The combination rig of claim 14, wherein the hinged support arm is attached to an elevator cylinder that reciprocably elevates the support arm thereby moving the coiled tubing drive wheel and the drive wheel frame into a stowed position, a ready position or an operating position.

16. The combination rig of claim 14, wherein the drive wheel frame rotates as the support arm is raised and lowered.

17. A mobile combination rig comprising:

a mobile support platform;

a mast mounted on the support platform in a storage position that is substantially horizontal over the support platform;

a coiled tubing storage reel mounted on the support platform; and a coiled tubing injector assembly mounted on the support platform in a storage position, wherein a portion of a drive wheel of the injector assembly is positioned within an opening in the mast and a rotatable drive wheel frame having a guide roller track and a plurality of holddown rollers attached to the drive wheel frame is positioned such that the guide roller track and the holddown rollers are proximal to the support platform.

18. The mobile combination rig of claim 17, further comprising a length of coiled tubing on the coiled tubing storage reel.

19. The mobile combination rig of claim 18, wherein the coiled tubing extends from the coiled tubing storage reel to the coiled tubing injector.

20. The mobile combination rig of claim 17, wherein the support platform is a trailer or a truck bed with a dropped center section.

21. The mobile combination rig of claim 20, wherein the coiled tubing storage reel is mounted on the dropped center section and the drive wheel frame is proximal to the dropped center section.

22. A combination rig comprising:

a mobile support platform;

an elevatable mast mounted on the support platform, wherein the mast has an attached lifting mechanism;

a selectably rotatable coiled tubing storage reel; and an elevatable coiled tubing injector assembly mounted on the support platform between the mast and the coiled tubing storage reel, wherein the injector assembly includes a drive wheel, a rotatable drive wheel frame having a guide roller track and a plurality of holddown rollers attached to the drive wheel frame, a hinged support arm attached at one end to the support platform and at a second end to the drive wheel frame, and an elevator cylinder that reciprocably elevates the support arm thereby moving the coiled tubing drive wheel and the drive wheel frame into a stowed position, a ready position or an operating position.

23. A combination rig comprising:

a support platform;

an elevatable rig mast mounted on the support platform, wherein the mast has an attached lifting mechanism;

a selectably rotatable coiled tubing storage reel; and an elevatable coiled tubing injector assembly mounted on the support platform proximal to the mast, wherein the coiled tubing injector assembly includes a coiled tubing drive wheel attached to a first end of a support arm having a second end pivotably mounted to the support platform, the support arm attached to an elevator cylinder that reciprocably pivots the support arm moving the coiled tubing drive wheel into a stowed position, a ready position, or an operating position;

whereby the mast and the coiled tubing injector are independently operable.

24. A combination rig comprising:

a support platform;

an elevatable rig mast mounted on the support platform, wherein the mast has an attached lifting mechanism;

a selectably rotatable coiled tubing storage reel; and an elevatable coiled tubing injector assembly mounted on the support platform, wherein the injector assembly includes a drive wheel, a rotatable drive wheel frame having a guide roller track and a plurality of holddown rollers attached to the drive wheel frame, and a hinged support arm attached at one end to the support platform and at a second end to the drive wheel frame, wherein the hinged support arm is attached to an elevator cylinder that reciprocably elevates the support arm thereby moving the coiled tubing drive wheel and the drive wheel frame into a stowed position, a ready position or an operating position.

* * * * *